United States Patent [19]

Taga

[11] Patent Number: 4,615,473

[45] Date of Patent: Oct. 7, 1986

[54] APPARATUS FOR ASSEMBLING A PAIR OF FASTENER ELEMENTS

[75] Inventor: Yukio Taga, Uozu, Japan

[73] Assignee: Nippon Notion Kogyo Co., Ltd., Tokyo, Japan

[21] Appl. No.: 687,013

[22] Filed: Dec. 28, 1984

[30] Foreign Application Priority Data

Dec. 29, 1983 [JP] Japan ..... 58-200489[U]
Dec. 29, 1983 [JP] Japan ..... 58-200491[U]
Dec. 29, 1983 [JP] Japan ..... 58-200490[U]

[51] Int. Cl.[4] ..... A41H 37/04

[52] U.S. Cl. ..... 227/15; 227/18; 227/116; 227/119; 227/149

[58] Field of Search ..... 227/15, 18, 30, 31, 227/116, 119, 149, 154, 155

[56] References Cited

U.S. PATENT DOCUMENTS 2,345,476 3/1944 Huelster et al. ..... 227/15
2,588,486 3/1952 Clarke ..... 227/154
3,964,661 6/1976 Schmidt et al. ..... 227/119 X
4,019,666 4/1977 Foults ..... 227/119

*Primary Examiner*—Robert L. Spruill
*Assistant Examiner*—Taylor J. Ross
*Attorney, Agent, or Firm*—Hill, Van Santen, Steadman & Simpson

[57] ABSTRACT

An apparatus, for assembling a pair of fastener elements of a garment fastener, including a lower or die unit having a retainer which is disposed immediately upstream of a die and which is vertically movable between a retracted position in which an upper end portion of the retainer is retracted below a top of the die to allow one fastener element to be supplied onto the die, and a projected position in which the upper end portion of the retainer projects from the top of the die to engage a peripheral edge of the head of the fastener element to thereby prevent the latter from being displaced on the die.

7 Claims, 18 Drawing Figures

APPARATUS FOR ASSEMBLING A PAIR OF FASTENER ELEMENTS

BACKGROUND OF THE INVENTION

1. Field of the Invention

The present invention relates to an apparatus for assembling a pair of fastener elements of a garment fastener, such as a snap fastener, a button or an ornament, with or without a garment fabric disposed between the two fastener elements.

2. Prior Art

Various fastener-assembling apparatus are known in which a pair of fastener elements of a garment fastener is supported on a lower or die unit and an upper or punch unit, respectively; a punch of the upper unit moves toward a die of the lower unit to join the two fastener elements together in clinched condition, with or without a garment fabric sandwiched between the two fastener elements. A common problem with such known apparatus is that the individual garment fastener element, which is relatively small, tends to be displaced particularly on the lower unit before the two fastener elements have been joined together, causing inaccurate joining of the two fastener elements with objectionable deformation or damage thereto.

SUMMARY OF THE INVENTION

According to the present invention, an apparatus, for assembling a pair of fastener elements of a garment fastener, includes a lower or die unit having a retainer which is disposed immediately upstream of a die and which is vertically movable between a retracted position in which an upper end portion of the retainer is retracted below a top of the die to allow one fastener element to be supplied onto the die, and a projected position in which the upper end portion of the retainer projects from the top of the die to engage a peripheral edge of the head of the fastener element to thereby prevent the latter from being displaced on the die.

It is therefore an object of the present invention to provide a fastener-assembling apparatus in which one of a pair of fastener elements can be retained on a die in vertical alignment with a punch and thus the other fastener element while the two fastener elements are joined together as compressed between the die and the punch.

Many other advantages, features and additional objects of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION

Figure 1:
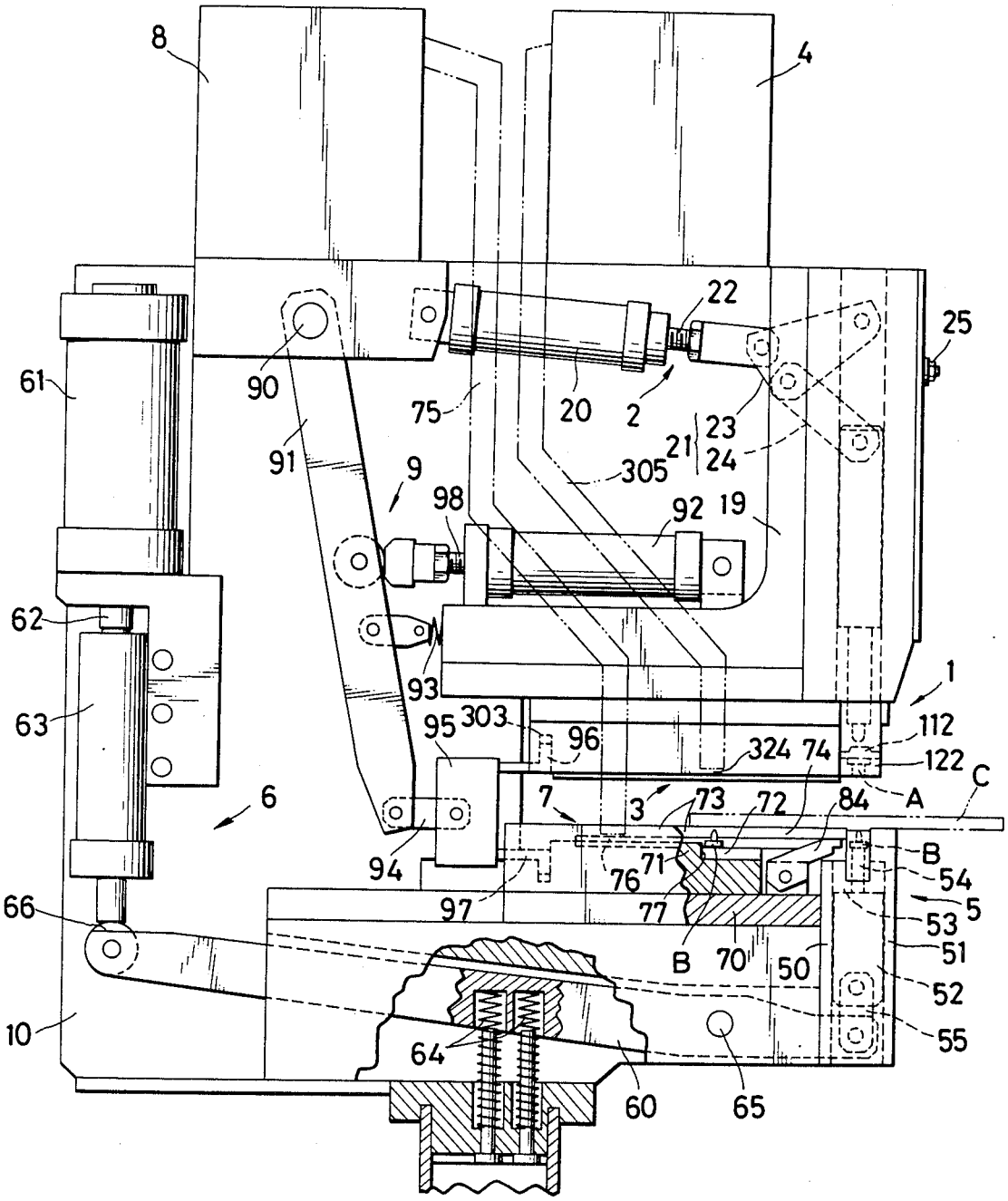
FIG. 1 is a side elevational view, with parts broken away, of an apparatus embodying the present invention.
Figure 18:
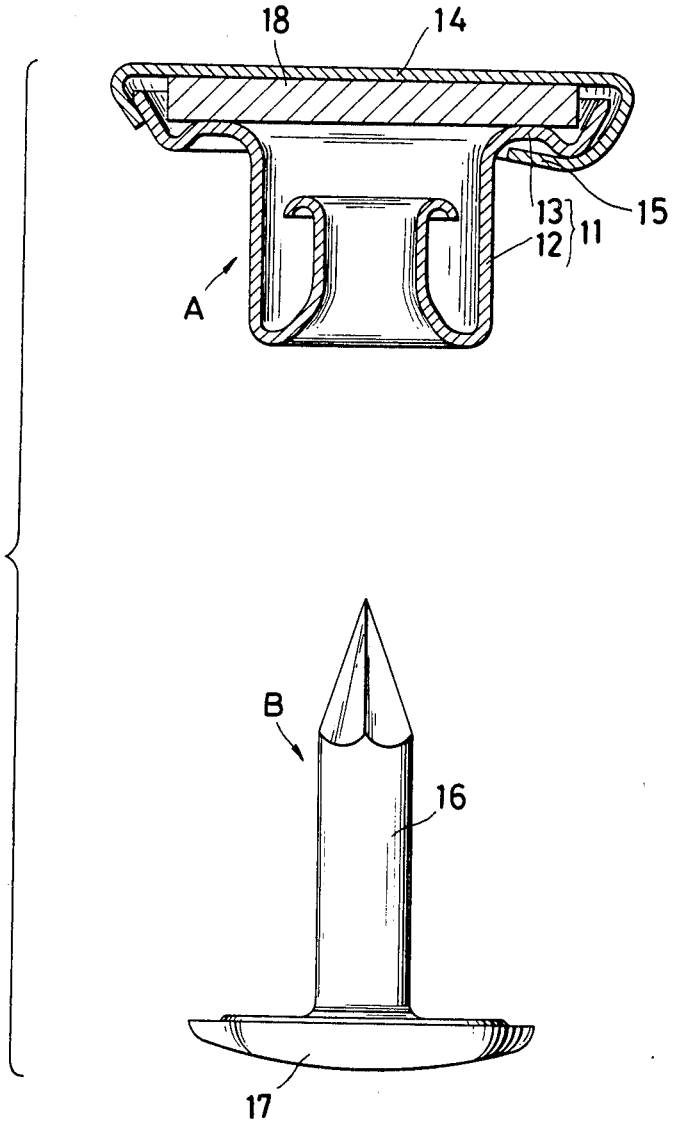
FIG. 18 is a front elevational view, partly in cross section, of a pair of fastener members to be joined together by the apparatus according to the present invention.

FIG. 1 shows an apparatus for joining a pair of first and second fastener elements A, B (illustrated in phantom lines) together, with or without a garment fabric C (illustrated in phamtom lines) disposed therebetween. In the illustrated embodiment, the first and second fastener elements A, B comprise a button and a tack, respectively. As best shown in FIG. 18, the button A includes a button back 11 which has an annular rim 13 covered by a cap 14. A circular back plate 18 is disposed between the button back 11 and the cap 14. The button back 11 also has a hollow shank 12 in the form of a double tube projecting centrally from an inner edge of the annular rim 13. The tack B has a disk-like head 17 and a spike 16 projecting centrally therefrom for piercing through the garment fabric C (FIG. 1) and also for being inserted through the hollow shank 12 of the button back 11.

The apparatus comprises an upper or punch unit 1, a first drive mechanism 2 for vertically moving a punch 112 of the upper unit 1, and a first pusher mechanism 3 for receiving a button A from a first feeder 4 and for supplying the button A to the upper unit 1. The apparatus also comprises a lower or die unit 5, a second drive mechanism 6 for vertically moving a die 54 of the lower unit 5, and a second pusher mechanism 7 for receiving a tack B from a second feeder 8 and for supplying the tack B to the lower unit 5. The first and second pusher mechanisms 3, 7 are driven in timed relation to each other by a third drive mechanism 9.

Figure 2:
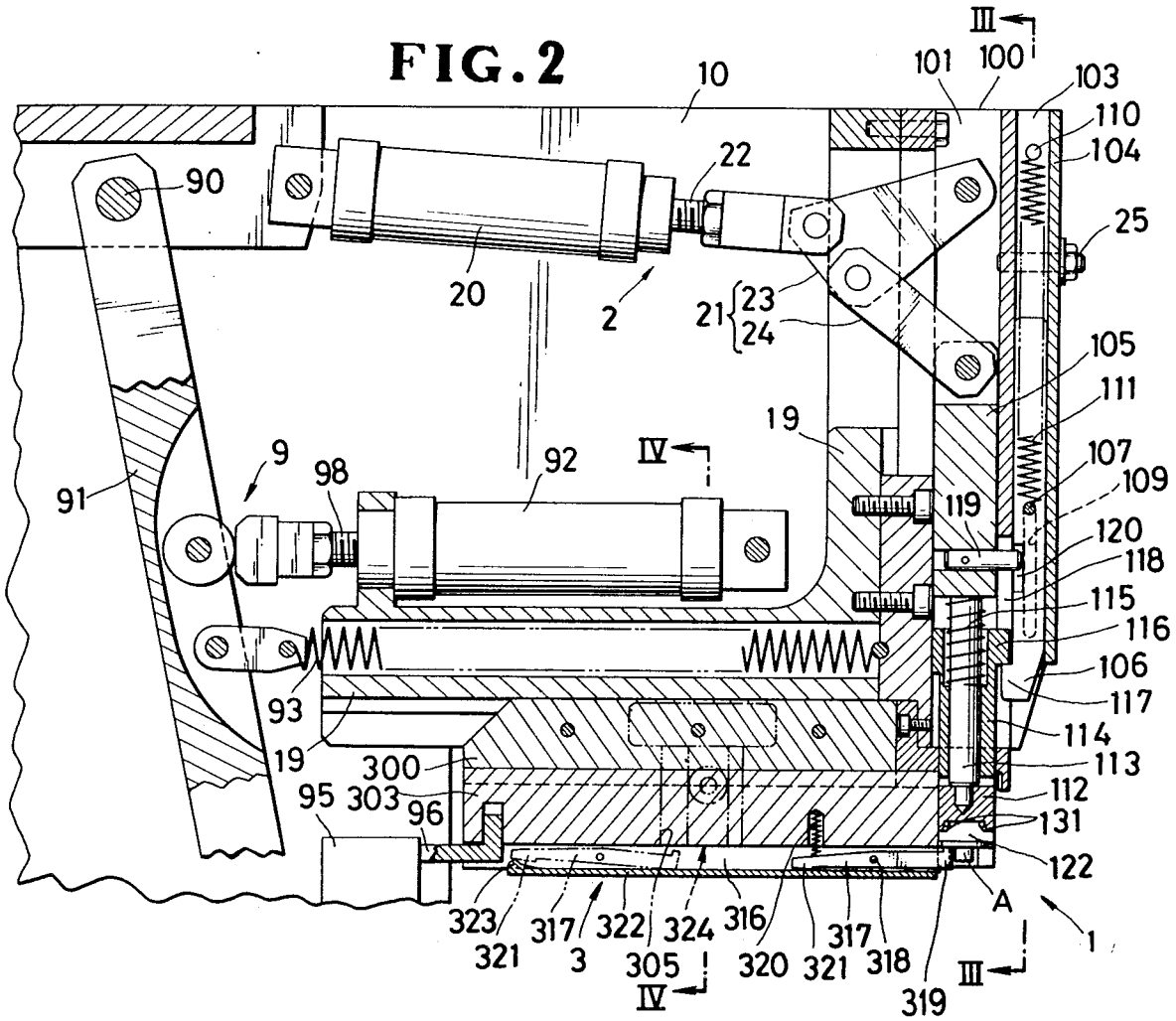
FIG. 2 is a fragmentary enlarged cross-sectional view of FIG. 1, showing an upper unit, a first drive mechanism and a first pusher mechanism.
Figure 3:
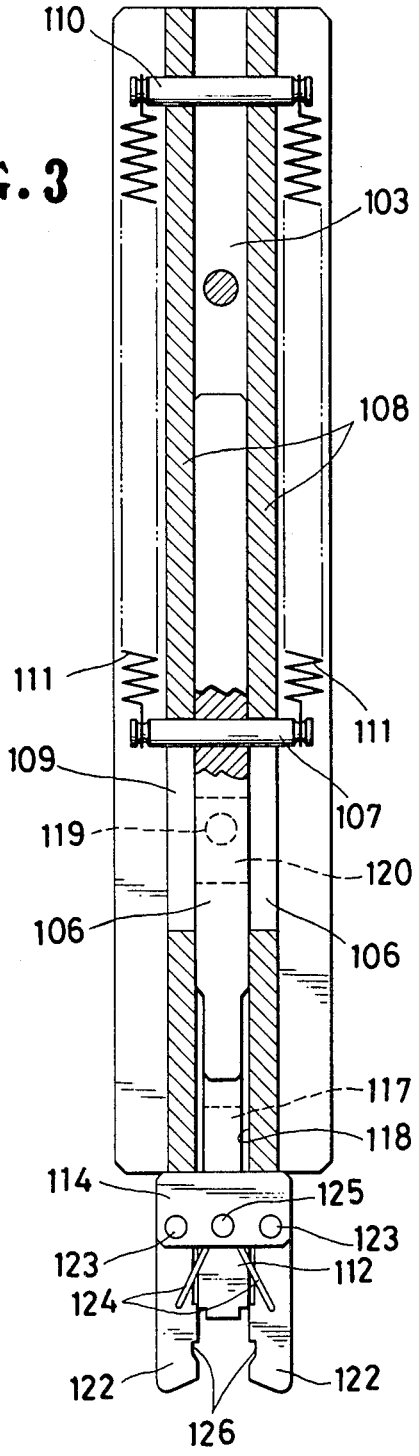
FIG. 3 is an enlarged cross-sectional view taken along line III—III of FIG. 2.

As best shown in FIG. 2, the upper unit 1 includes a guide 100 fixed to a support 19 and having a first vertical channel 101, and an upper plunger 105 reciprocable vertically within the first vertical channel 101 in the guide 100, a cover plate 104 attached to the guide 100 at its front side and defining therewith a second vertical channel 103, and a slide 106 vertically slidable within the second vertical channel 103, the support 19 being fixed to a frame 10. As shown in FIGS. 2 and 3, a first horizontal rod 107 is mounted on the slide 106 and has opposite end portions slidably received in a pair of vertical slots 109, 109 disposed in a pair of opposite side members 108, 108 of the guide 100, and a second horizontal rod 110 is mounted on the side members 108, 108 of the guide 100 at its upper portion. A pair of extension springs 111, 111 is mounted between the first and second rods 107, 110 to normally urge the slide 106 upwardly. The first rod 107 coacts with the vertical slots 109, 109 to restrict the upward movement of the slide 106.

The plunger 105 is operatively connected at its upper end to the first drive mechanism 2 for vertical reciprocating movements toward and away from the lower unit 5. At its lower end, the plunger 105 has a coaxial head 113 vertically slidably supported by a first support block 114 which is in turn vertically slidably received in the first vertical channel 101 in the guide 100. A compression spring 115 extends around the plunger head 113 and acts between the plunger 105 and the support block 114 to normally urge the latter downwardly away from the plunger 105. The downward movement of the support block 114 is restricted by a hook portion 117 of the slide 106; the hook portion 117 projects into a slot 118 in the guide 100 and is engageable with a lateral projection 116 extending from an upper end of the support block 114 into the slot 118. The punch 112 is fixed to the lower end of the plunger head 113.

The vertical movements of the plunger 105 and the slide 106 relative to one another is restricted by a horizontal pin 119 mounted on the plunger 105 and projecting through the slot 118 into a recess 120 in the slide 106.

Figure 7:
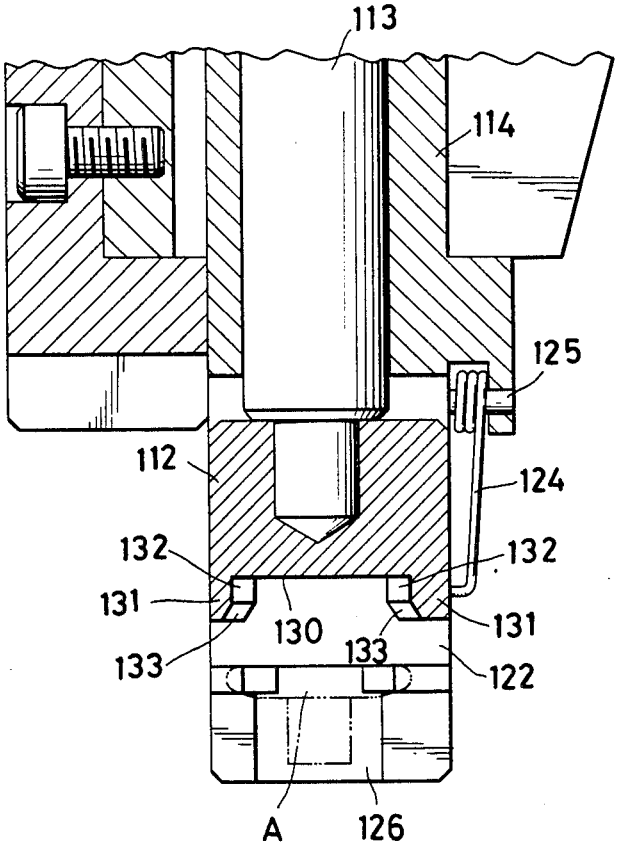
FIG. 7 is a fragmentary enlarged cross-sectional view of FIG. 2, showing a punch of the upper unit.
Figure 8:
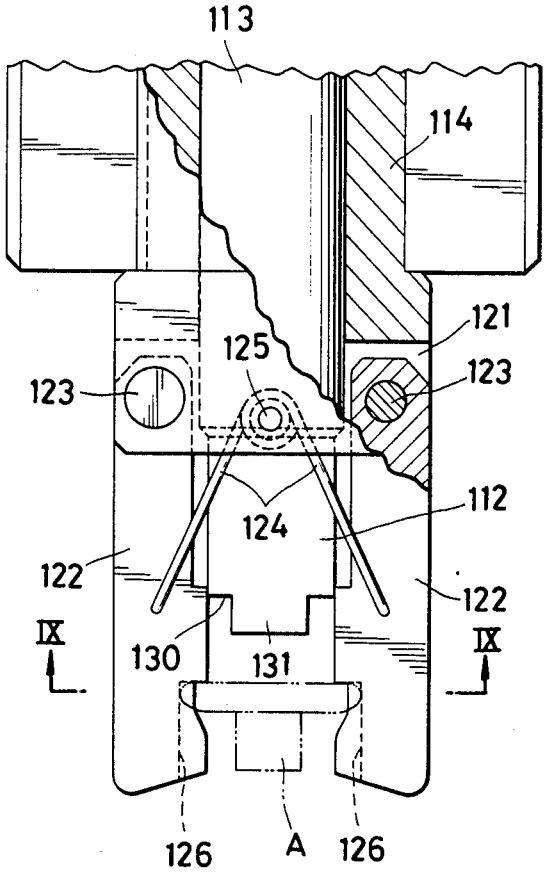
FIG. 8 is a front elevational view, partly in cross section, of FIG. 7, illustrating the manner in which a button is held by a pair of clamp members.

As better shown in FIGS. 7 and 8, the support block 114 has in its lower end a pair of vertical slits 121, 121 (only one illustrated in FIG. 8) in which a pair of clamp members 122, 122 is pivotally mounted by a pair of pins 123, 123, respectively. A torsion spring 124 is supported on the support block 114 by a pin 125 and acts on the clamp members 122, 122 to normally urge the latter toward each other for clamping a button A therebetween. Such inward movements of the clamp members 122, 122 under the biasing force of the torsion spring 124 are restricted by the punch 112 so that, in the absence of a button A between the clamp members 122, 122, the distance therebetween is smaller than the diameter of the cap 14 of the button A. When a button A is supplied into the space between the clamp members 122, 122 by the first pusher mechanism 3, the cap 14 of the button A pushes the clamp members 122, 122 away from each other against the bias of the torsion spring 124 until the button A is placed between a pair of clamp portions 126, 126 of the clamp members 122, 122. The button A thus clamped between the clamp members 122, 122 is lowered by the first drive mechanism 2 to a lower position where the button A is joined with a mating tack B by the die 54 and the punch 112.

The first drive mechanism 2, as shown in FIGS. 1 and 2, includes an air cylinder 20 and a toggle joint 21 composed of a pair of first and second levers 23, 24, the air cylinder 20 being pivotally supported on the frame 10. The first lever 23 is pivotally secured at one end thereof to the guide 100 and is pivotally connected at the other end to a piston rod 22 of the air cylinder 20, while the second lever 24 is pivotally connected at opposite ends to the second lever 23 and the plunger 105. In response to reciprocating movement of the piston rod 22, the first and second levers 23, 24 are pivotally moved relative to each other between a first position in which the two levers 23, 24 are disposed substantially at a right angle to one another, and a second position in which the two levers 23, 24 are disposed substantially in a vertical straight line. A stop 25 is supported on the guide 100 and is engageable with the first lever 23 to restrict the forward or rightward movement thereof in such a manner that the first lever 23 is not allowed to move beyond such vertical line. Thus while the two levers 23, 24 are moved between the first and second positions, the plunger 105 is moved vertically.

As shown in FIGS. 2 and 4–6, the first pusher mechanism 3 includes a first elongated guide base 300 secured to the under side of the support 19, and a pair of parallel guide plates 302, 302 secured to the under side of the guide base 300. The first guide base 300 and the two guide plates 302, 302 jointly define a longitudinal guide channel 301 of a T-shaped cross section, in which a first elongated pusher 303 of a T-shaped cross section is slidably received. The two guide plates 302, 302 have in their inner surfaces a pair of grooves 304, 304 (FIG. 6) for guiding the head portion of a button A.

Figure 4:
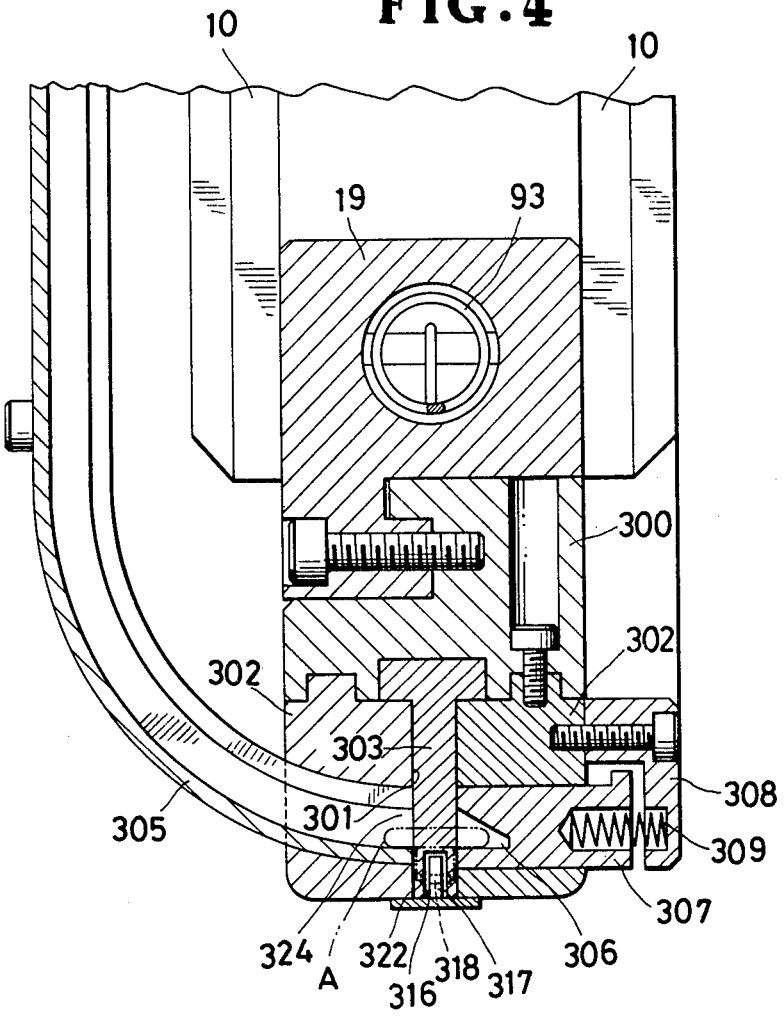
FIG. 4 is an enlarged cross-sectional view taken along line IV—IV of FIG. 2.
Figure 6:
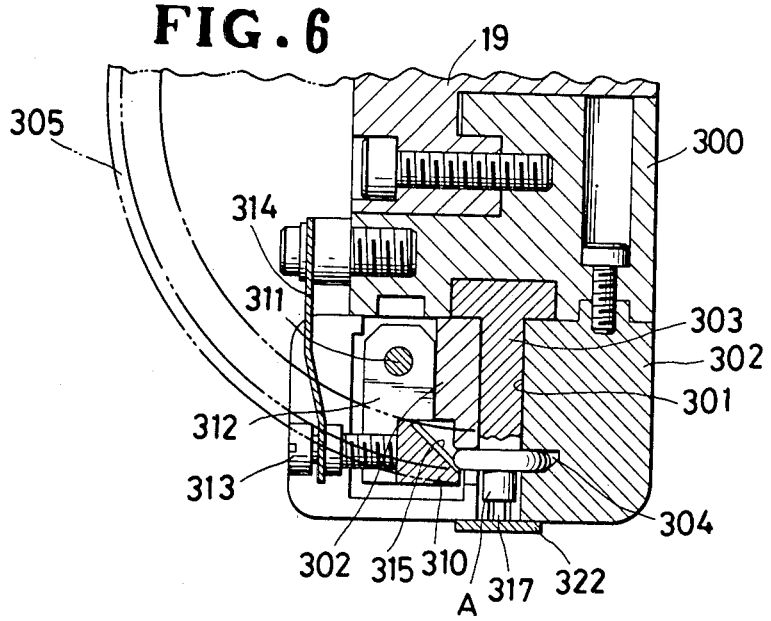
FIG. 6 is a cross-sectional view taken along line VI—VI of FIG. 5.

As shown in FIG. 4, a first chute 305, for delivering the successive buttons A to the first pusher mechanism 3, has a lower end portion extending through the left guide plate 302 and communicates with the left groove 304 (FIG. 6) at the junction 324. An auxiliary guide 307 is slidably supported on the right guide plate 302 and extends therethrough. The auxiliary guide 307 has a generally V-shaped groove 306 communicating with the right groove 304 (FIG. 6). A compression spring 309 acts between a cover 308 (fixed to the right guide plate 302) and the auxiliary guide 307 to resiliently hold the latter in a proper position for receiving a button A. When the auxiliary guide 307 is removed together with the cover 308, a button A jammed at the junction 324 can be removed.

Figure 5:
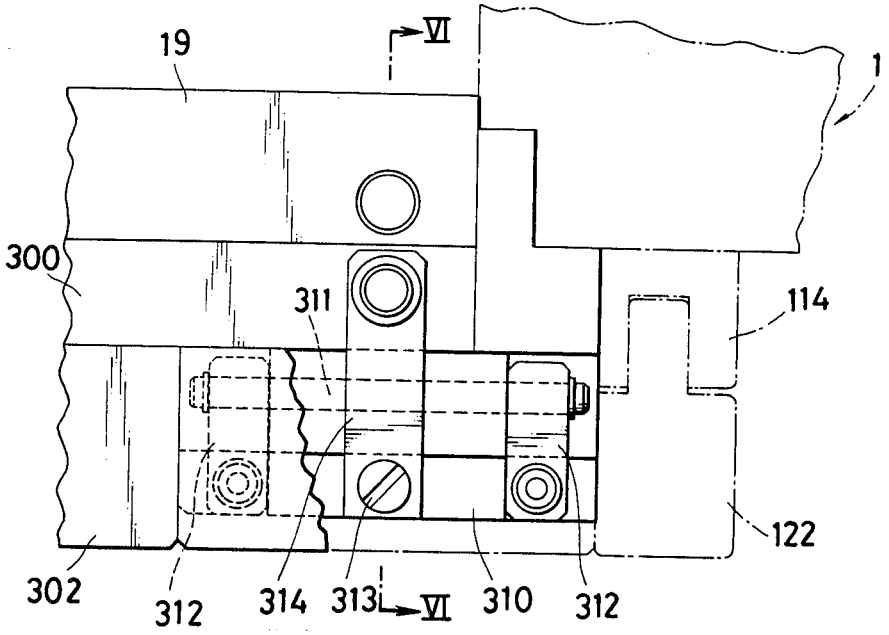
FIG. 5 is a fragmentary enlarged side elevational view of FIG. 2, showing a forward end portion of the first pusher mechanism.

As shown in FIGS. 5 and 6, a parts-turning block 310 is disposed along the groove 304 in the left guide 302 at a portion thereof near the upper unit 1. The parts-turning block 310 is fixed to free ends of a pair of arms 312, 312 which are pivotally supported on the left guide plate 302 by means of a rod 311. The parts-turning block 310 is normally urged rightwardly by means of a leaf spring 314 which supports on its free end a screw 313 threadedly extending through the leaf spring 314. The amount of the resilient force which is exerted on the parts-turning block 310 can be adjusted by turning the screw 313. The parts-turning block 310 has a slanted surface 315 engageable with the under periphery of the cap 14 (FIG. 18) of a button A when the latter is supplied into the groove 304. The slanted surface 315 is corrugated to enable stable contact with the under periphery of the button cap 14.

As shown in FIGS. 2 and 4, the first pusher 303 has in its lower surface a longitudinal channel 316 in which a parts-locking lever 317 is pivotally mounted near a forward or right end of the channel 316 by means of a pin 318. The parts-locking lever 317 has a forward end projecting from the forward end of the channel 316 and terminating in an upwardly directed hook 319 which is engageable with a tab portion 15 (FIGS. 9 and 18) of a button's cap 14. A compression spring 320 acts between the pusher 303 and the parts-locking lever 317 to normally urge the latter to pivot counterclockwise (FIG. 2), thus retaining the first hook 319 in engagement with the tab portion 15 of the button cap 14. The counterclockwise pivotal movement of the parts-locking lever 317 is restricted by a bottom plate 322 fixed to the under side of the guides 302, 302; the parts-locking lever 317 has a downwardly directed rear end 321 which is engageable with the upper surface of the bottom plate 322, thus preventing the button A from being raised (from its proper position) by the hook 319.

When the first pusher 303 is retracted, the part-locking lever 317 is moved from the solid-line position to the phantom-line position. At that time the rear end 321 of the parts-locking lever 317 slides on the upper surface of the bottom plate 322 and finally rides on a cam or protuberance 323 projecting from the rear end of the bottom plate 322. As a result, the parts-locking lever 317 is pivotally moved clockwise against the bias of the spring 320. The hook 319 is thereby retracted to such a position that its uppermost end is disposed below the tab portion 15 of a succeeding button A at the junction 324 of the first chute 305 and the guide channel 301.

A succession of the buttons A are delivered from the first feeder 4 to the junction 324 via the first chute 305. While the forward end of the first pusher 303 is disposed forwardly (rightwardly) of the junction 324, a leading one of the successive buttons A which has reached the junction 324 is prevented from entering the groove 304. When the forward end of the pusher 303 is disposed behind the junction 324 as the pusher 303 is fully retracted, the leading button A slides into the groove 304 in front of the pusher's forward end. Then the leading button A is pushed forwardly along the groove 304 by the pusher 303 as the latter is moved forwardly, during which time entering of the succeeding buttons A into the junction 324 is prevented by the projected pusher 303. Thus the successive buttons A are supplied one at a time to the upper unit 1.

In response to the forward movement of the first pusher 303, the rear end 321 of the parts-locking lever 317 is removed from the protuberance 323 on the rear end of the bottom plate 322, causing the parts-locking lever 317 to be pivotally moved counterclockwise until the hook 319 of the lever 317 is able to engage with the tab portion 15 of the button A. Then when the button A is brought into contact with the slanted surface 315 of (FIG. 6) of the parts-turning block 310 as the button A is pushed by the pusher 303, the button A begins to be turned clockwise as views from above. This turning of the button A continues until the tab portion 15 of the button A is engaged by the hook 319 of the parts-turning lever 317. Thus the button A has been oriented in a specified direction that is required by a design, symbol or other emblem (not shown) on the front face of the button A.

As shown in FIG. 1, the lower unit 5 includes a base 50 fixedly supported by the frame 10, a second support block 51 fixed to the base 50, and a lower plunger 52 reciprocable vertically within a third vertical channel 53 in the support block 51. A die 54 is fixed to the upper end of the lower plunger 52. The lower plunger 52 is operatively connected to the second drive mechanism 6.

The second drive mechanism 6 includes a third lever 60 pivotally supported on the frame 10 by means of a pin 65, a second air cylinder 61 fixed to the frame 10, a shock absorber 63 disposed between a piston rod 62 of the second air cylinder 61 and a roller 66 rotatably mounted on one end of the third lever 60. The other end of the third lever 60 is connected to the lower end of the lower plunger 52 via a link 55. The third lever 60 is normally urged by a pair of compression springs 64, 64 to pivot clockwise in such a manner that the roller 66 on the left end of the third lever 60 pushes the piston rod 62 of the second air cylinder 61 upwardly to its retracted position via the shock absorber 63 and also in such a manner that the right end of the third lever 60 pulls the lower plunger 52 and thus the die 54 to its lowered position via the link 55. When the piston rod 62 of the second air cylinder 61 is actuated to push the roller 66 on the left end of the third lever 60 downwardly via the shock absorber 63, the third lever 60 is pivotally moved counterclockwise to raise the lower plunger 52 and the die 54.

As shown in FIGS. 1 and 13–16, the second pusher mechanism 7 includes a second elongated guide base 70 fixedly supported by the frame 10, a pair of parallel guide plates 73, 73 secured to the upper side of the guide base 70 so as to define therebetween a longitudinal guide channel 72, and a second elongated pusher 71 slidably received in the guide channel 72. The two guides plates 73, 73 have in their inner surfaces a pair of grooves 74, 74 for guiding the head portion of a tack B.

Figure 14:
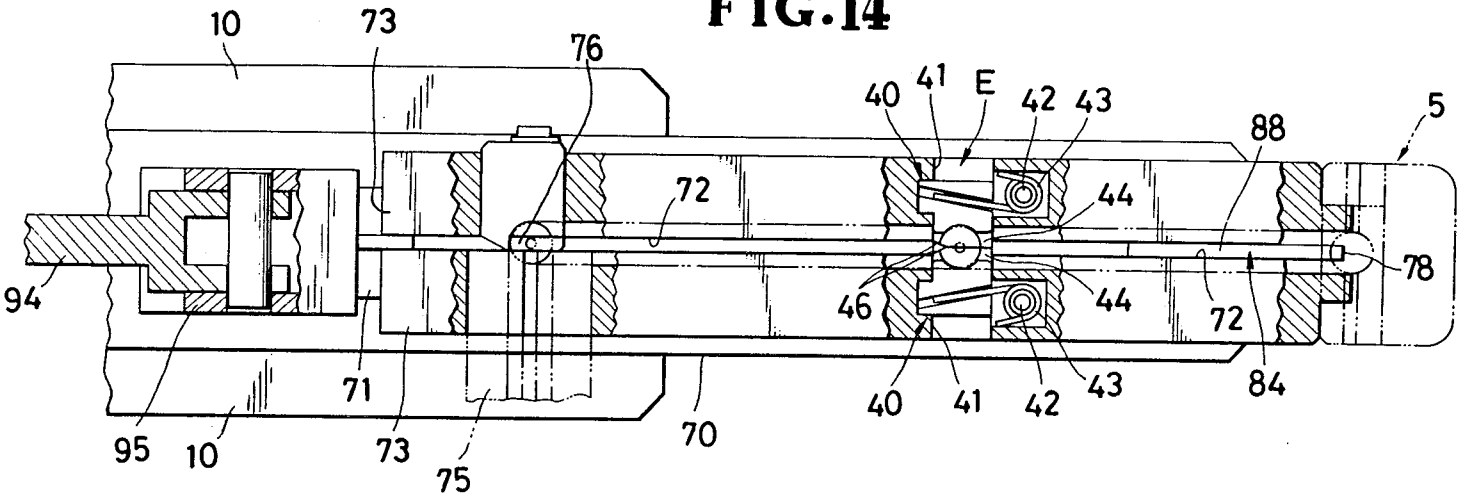
FIG. 14 is a plan view, partly in cross section, of FIG. 13.
Figure 15:
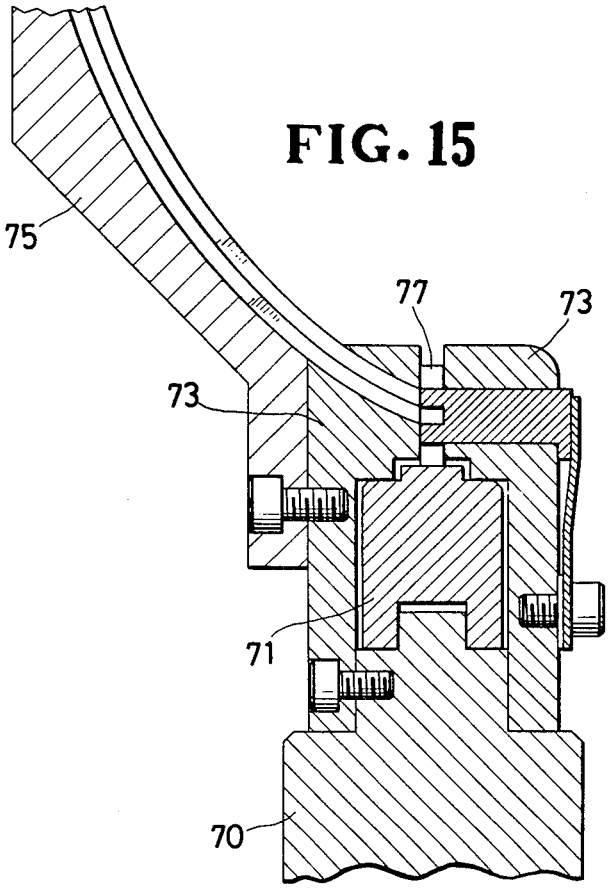
FIG. 15 is a cross-sectional view taken along the line XV—XV of FIG. 13.
Figure 16:
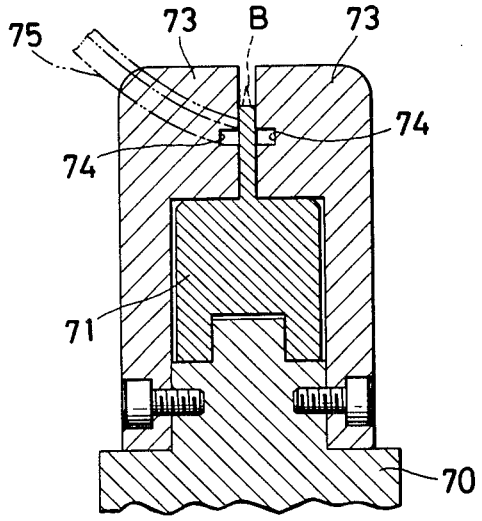
FIG. 16 is a cross-sectional view taken along line XVI—XVI of FIG. 13.

A second chute 75, for delivering the successive tacks B to the second pusher mechanism 7, has a lower end portion extending through one of the guide plates 73 and communicates with the corresponding groove 74 at the junction 76 (FIGS. 1 and 14).

The second pusher 71 has a pair of first and second pushing surfaces 77, 78; in response to the reciprocating movement of the second pusher 71, the first pusher surface 77 is moved between a rear position behind the junction and an intermediate position E (FIGS. 13 and 14), while the second pushing surface 78 is moved between the intermediate position E and a forward position in which a tack B is placed onto the die 54. The second pushing surface 78 is a free end surface of a pushing arm 84 pivotally supported on the forward end 79 of the second pusher 71 by means of a pin 85. The pushing arm 84 is normally urged by a torsion spring 86 to pivot counterclockwise (FIG. 13), causing the second pushing surface 78 of the pushing arm 84 to project into a tack-supply path.

Figure 13:
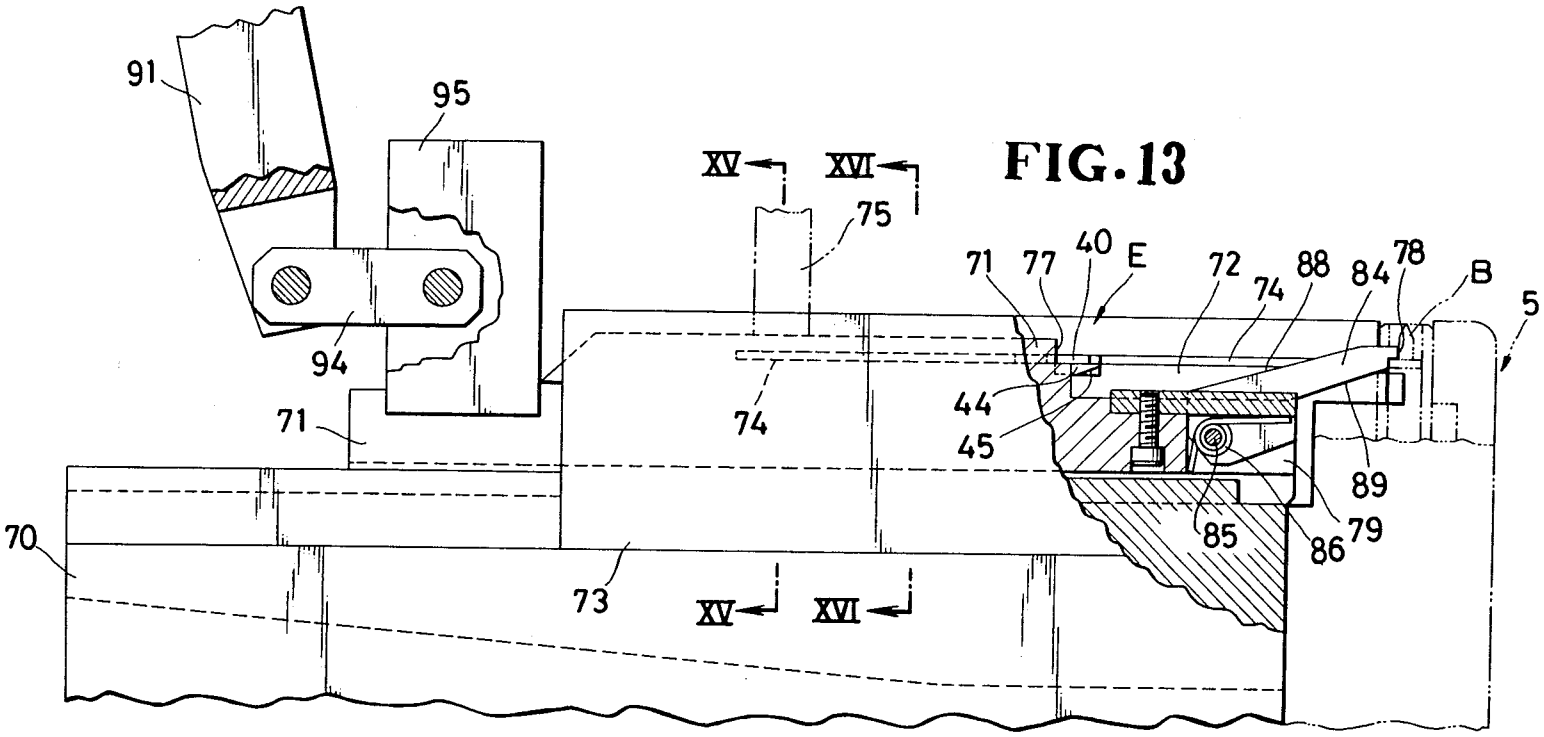
FIG. 13 is a fragmentary enlarged view, partly in cross section, of FIG. 1, showing a second pusher mechanism.

As shown in FIGS. 13, 14, a pair of clamping members 40, 40 is mounted on the guide plates 73, 73, respectively, at the intermediate position E for clamping a tack B, each clamping member 40 being received in a recess 41 in a respective one of the guide plate 73. A pair of torsion springs 43, 43 (FIG. 14) are mounted around a pair of pins 42, 42 (FIG. 14), respectively, to normally urge the two clamping members 40, 40 toward each other for holding a tack B therebetween.

Figure 17:
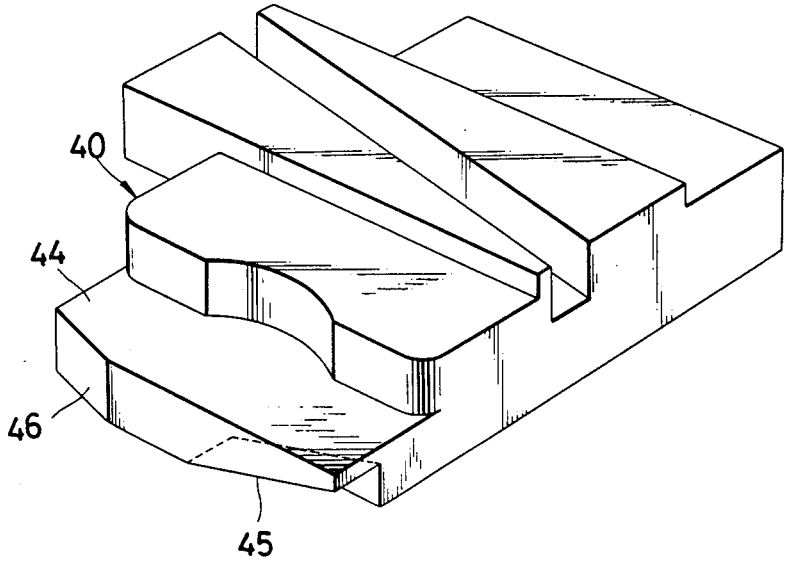
FIG. 17 is an enlarged perspective view of one of a pair of clamping members of FIG. 14.

Each clamping member 40 has an integral guide projection 44 (FIGS. 13, 14 and 17) disposed below the tack-supply path and extending into the guide channel 72. The guide projection 44 has on its lower side a first slanted camming surface 45 (FIGS. 13 and 17) which is engageable with the upper edge 88 of the pushing arm 84 when the latter is moved backwardly under the clamping members 40, 40 when the second pusher 71 is retracted. The guide projection also has on its inner side a second slanted surface 46 (FIGS. 14 and 17). The second slanted surfaces 46, 46 of the two guide projections 44, 44 diverge rearwardly. As the second pusher 71 approaches its retracted position, the upper edge 88 of the pushing arm 84 engages the first slanted surface 45 to cause the pushing arm 84 to pivot clockwise in FIG. 13 against the bias of the torsion spring 86. With the continued retraction of the second pusher 71, the free end of the pushing arm 84, i.e. the second pushing surface 78, passes the clamping members 40, 40 without engaging a tack B clamped therebetween. When the free end of the pushing arm 84 has passed the guide projections 44, 44, the pushing arm 84 pivots counterclockwise in FIG. 13 by the bias of the torsion spring 86 until the lower edge 89 of the pushing arm 84 faces the second slanted surfaces 46, 46 of the guide projections 44, 44. Then when the second pusher 71 is moved forwardly, the pushing arm 84 is moved forwardly to push a tack B out of the clamping members 40, 40 to the die 54. At that time the lower edge 89 of the pushing arm 84 engages the second slanted surfaces 46, 46 of the guide projections 44, 44 so as to separate the clamp members 40, 40 away from each other against the bias of the torsion springs 86, 86.

The first pusher mechanism 3 and the second pusher mechanism 7 are driven in timed relation to each other by the third drive mechanism 9. As shown in FIGS. 1, 2, 13 and 14, the third drive mechanism 9 includes a fourth lever 91 having an upper end pivotally supported on the frame 10 by means of a pin 90, a third air cylinder 92 fixed to the support 19 for causing the fourth lever 91 to pivot, an extension spring 93 acting between the support 19 and the fourth lever 91 to normally urge the latter toward the third air cylinder 92, and a pushing block 95 connected to a lower end of the fourth lever 91 via a link 94. The first pusher 303 of the first pusher mechanism 3 is connected to the pushing block 95 by a first connector 96, while the second pusher 71 of the second pusher mechanism 7 is connected to the pushing block 95 by a second connector 97.

The piston rod 98 of the third air cylinder 92 is normally retracted so that the first and second pushers 303, 71 normally assume their advanced position under the bias of the extension spring 93. Then as the piston rod 98 of the third air cylinder 92 projects, the fourth lever 91 pivots clockwise in FIG. 1 about the pin 90 to cause the first and second pushers 303, 71 to be moved to their retracted position, thus allowing a succeeding button A and a succeeding tack B to be delivered into the guide channels 301, 72 in front of the first and second pushers 303, 71, respectively.

With the piston rods 22, 62, 98 of the first, second and third air cylinders 20, 61, 92 retracted, when the third air cylinder 92 is energized, the fourth lever 91 pivots counterclockwise (FIG. 1) to cause the first and second pushers 303, 71 to be moved to their advanced position. During that time, the first pusher 303 pushes a button A forwardly through the guide channel 301 until the button A is clamped between the clamp members 122, 122 in the upper unit 1, while the second pusher 71 pushes a tack B forwardly through the guide channel 72 until the tack B is placed on the die 54 in the lower unit 5.

Figure 9:
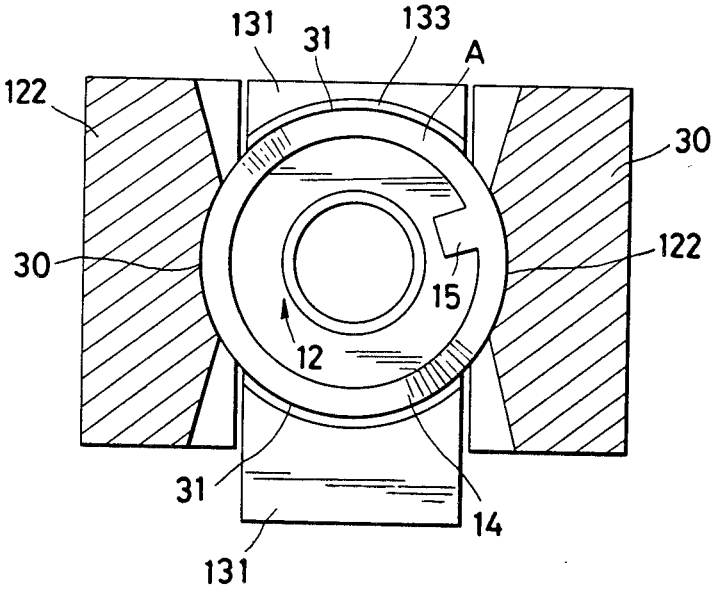
FIG. 9 is an enlarged cross-sectional view taken along line IX—IX of FIG. 8.

As shown in FIGS. 7, 8 and 9, the punch 112 has a pair of guide projections 131, 131 extending downwardly from a lower surface 130 of the punch 112, the radial center line of each guide projection 131 lying at a right angle to the radial center lines of the clamp members 122, 122 as shown in FIG. 9. The two guide projections 131, 131 have a pair of arcuate inner vertical surfaces 132, 132 complementary to the peripheral edge 31 of a button A for fittingly receiving the latter between the two inner surfaces 132, 132. The two guide projection 131, 131 also have a pair of slanted surfaces 133, 133 contiguous to the respective vertical surfaces 132, 132 and diverging downwardly, for a purpose described below.

As shown in FIGS. 1 and 2, the first and second levers 23, 24 of the toggle joint 21 assume a dogleg shape. When the first air cylinder 20 is energized, the first and second levers 23, 24 begin to become aligned thus causing the upper plunger 105 to be moved downwardly against the bias of the compression spring 115. The punch 105 is thereby moved downwardly so that the guide projections 131, 131 are brought into contact with a button A clamped between the clamp members 122, 122. At that time, if the button A is vertically unaligned with the punch 105, the slanted surface 133 of only one guide projection 131 comes in contact with the peripheral edge 31 of the button A to guide the button A to a proper position in which the peripheral edge 31 of the button A is vertically aligned with the inner surfaces 132, 132 of the two guide projections 131, 131 and in which the button A is vertically aligned with the tack B placed on the die 54. As a result, the button A has been fitted between the inner surfaces 132, 132 of the two guide projections 131, 131.

With continued extension of the toggle joint 21, as shown in FIGS. 2 and 3, the horizontal pin 119 supported by the upper plunger 105 is brought into engagement with the lower end of the recess 120 in the slide 106 and then pushes the latter downwardly gainst the bias of the extension springs 111, 111 so that the hook portion 117 of the slide 106 engages the projection 116 of the support block 114. With the projection 116 engaged by the support block's hook portion 117, the support block 114 continues to be moved downwardly together with the slide 106.

The lowering of the upper plunger 105 is continued until the toggle joint 21 becomes fully extended, i.e. the first and second levers 23, 24 are vertically lined up, at which time the lower end surfaces of the clamp members 122, 122 are in contact with a garment fabric C (FIG. 1) placed over the tack B. The stop 25 serves to prevent the first and second levers 23, 24 from being pivotally moved beyond such vertical position.

Upon the full extension of the toggle joint 21, the first air cylinder 20 is temporarily de-energized and remain in this position. Subsequently, as the second air cylinder 61 is energized, the piston rod 62 projects to downwardly push the roller 66 on the rear end of the third lever 60 via the shock absorber 63, thus causing the third lever 60 to pivot counterclockwise in FIG. 1. The lower plunger 52 and thus the die 54 is thereby moved upwardly, with the tack B placed on the die 54 (with the spike 16 directed upwardly). As a result, the spike 16 of the tack B pierces through the garment fabric C and is then inserted through the shank 12 of the button A, and the distal end of the spike 16 is finally deformed so as to join the tack B and the button A together, thus attaching the latter to the garment fabric C.

Upon completion of the attaching operation of the button A, the piston rods 22, 62, 98 of the first, second and third air cylinders 20, 61, 92 are returned to their original positions in timed relation to one another so that the punch 112 and the die 54 are retracted away from each other. Thereafter, the first and second pushers 303, 71 is moved forwardly to supply a succeeding button A and a succeeding tack B to the upper unit 1 and the lower unit 2, respectively, for a subsequent attaching operation.

Figure 10:
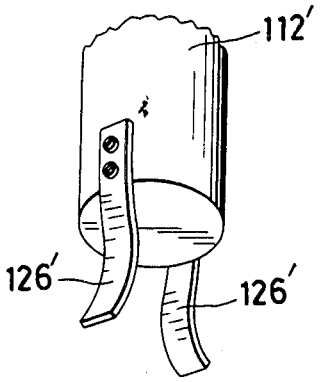
FIG. 10 is a fragmentary perspective view of a modified punch.

In the embodiment of FIGS. 2, 7, 8 and 9, the guide projections 131, 131 are integral with the punch 112. In an alternative form shown in FIG. 10, however, the punch 112' has a pair of guide members 126', 126' each comprising a separate leaf spring fixed to the punch 112'. Further, the slanted surfaces 133 (FIGS. 7 and 9) of the guide projections 131, 131 may be concave.

Because of the slanted surfaces 133, 133, the guide projections 131, 131 of the punch 112 serve to correct misplacement of a button A between the clamp members 122, 122 so that the button A is vertically aligned with a tack B, thus enabling accurate joining of the button A with the tack B without any deformation or other damage to either fastener element.

Figure 11:
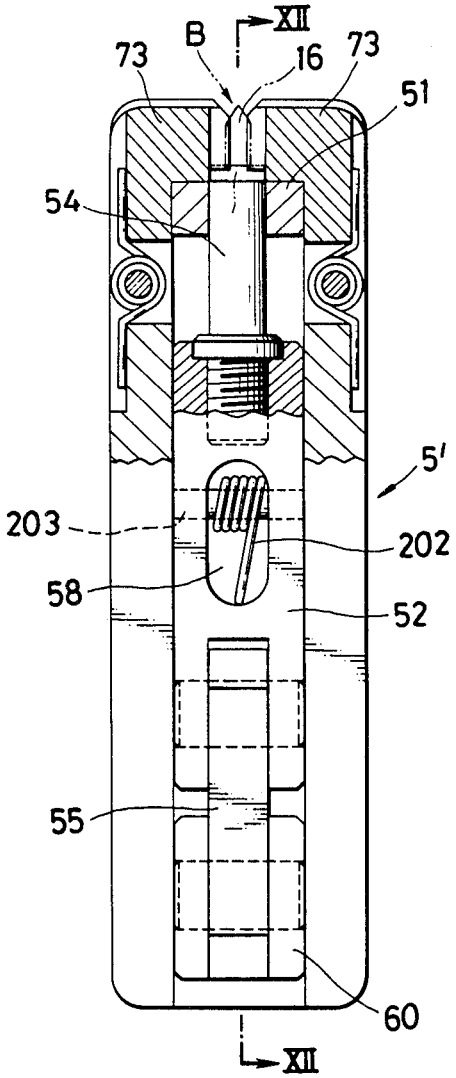
FIG. 11 is a fragmentary enlarged side elevational view, partly in cross section, of FIG. 1, showing a lower unit.
Figure 12:
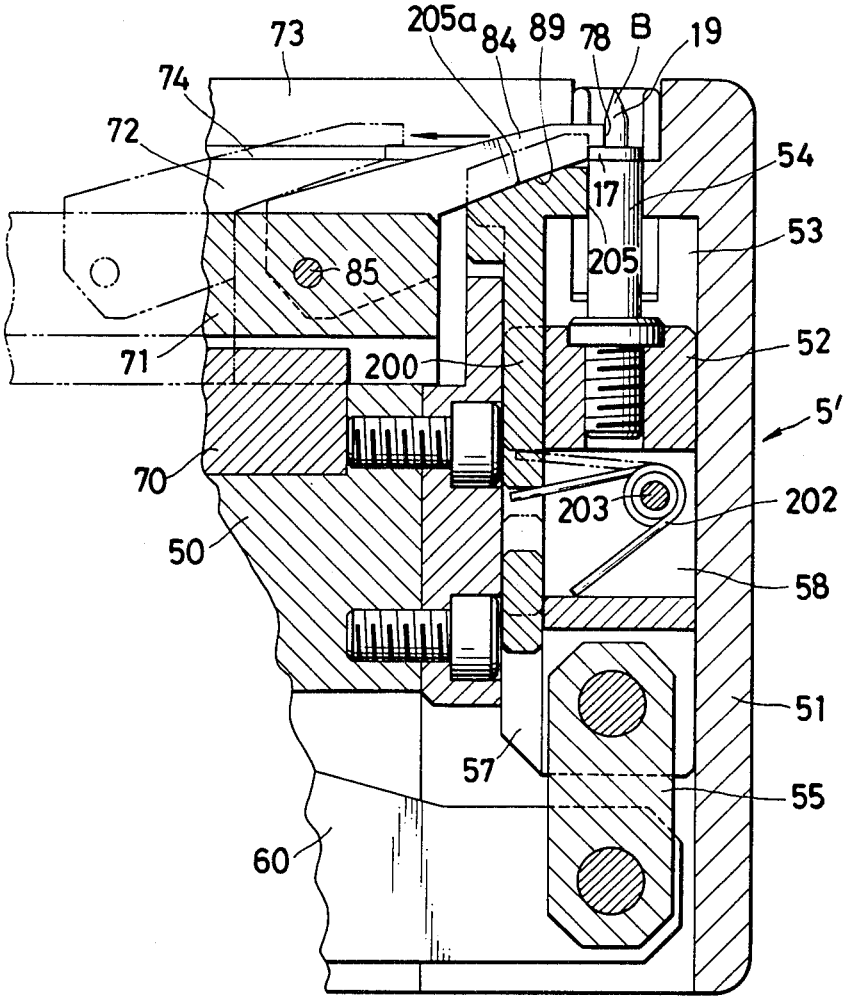
FIG. 12 is a cross sectional view taken along line XII—XII of FIG. 11.

FIGS. 11 and 12 illustrate a modified lower unit 5' which has a retainer 200 disposed immediately upstream of the lower plunger 52 and the die 54 for preventing a tack B from being displaced on the die 54. The retainer 200 is vertically slidable, in a vertical slot 57 in the second support block 51, between a projected position (phantom lines in FIG. 12) in which an upper end portion 205 of the retainer 200 projects from the top of the die 54 to engage the head 17 of a tack B, and a retracted position (solid lines in FIG. 12) in which the upper end portion 205 of the retainer 200 is retracted below the top of the die 54 to allow a succeeding tack B to be supplied onto the top of the die 54. The lower plunger 52 has a bore 58 in which a torsion spring 202 is mounted by a pin 203. The torsion spring 202 acts between the lower plunger 52 and the retainer 200 to normally urge the latter to its projected position. The upper end portion 205 of the retainer 200 has a slanted top surface **205*a* which is engageable by the lower edge 89 of the pushing arm 84 as the second pusher 71 is moved to its advanced position (solid lines in FIG. 12); thus the retainer 200 is depressed to its retracted position by the pushing arm 84 against the bias of the torsion spring 202. Because of the retainer 200**, it is possible to join the tack B with the button A together accurately with no objectionable deformation or damage to either fastener element.

Although various minor modifications may be suggested by those versed in the art, it should be understood that I wish to embody within the scope of the patent warranted thereon, all such embodiments as reasonably and properly come within the scope of my contribution to the art.

What is claimed is:

1. An apparatus for assembling a pair of fastener elements of a garment fastener, comprising:

(a) a frame;

(b) a pair of vertically aligned upper and lower units supported by said frame for receiving the respective fastener elements, said lower unit including a lower plunger reciprocably supported by said frame and having a die, said upper unit including an upper plunger reciprocably supported by said frame and having a punch movable, in response to reciprocating movement of said upper plunger, toward and away from said die to join the two fastener elements together;

(c) a first pusher mechanism including first means supported by said frame and defining a first guide channel receptive of one fastener element, said first pusher mechanism also including a first pusher reciprocable within said first guide channel to push the one fastener element therethrough to said upper unit; and (d) a second pusher mechanism including second means supported by said frame and defining a second horizontal guide channel receptive of the other fastener element, said second pusher mechanism also including a second pusher reciprocable within said second guide channel to push the other fastener element therethrough to said lower unit; and (e) said lower unit further including a retainer disposed between said die and said second pusher mechanism immediately upstream of said die and said lower plunger, said retainer being normally urged upwardly and being vertically movable in response to reciprocating movement of said second pusher, between a retracted position in which an upper end portion of said retainer is retracted below a top of said die for allowing the other fastener element to be supplied onto the top of said die, and a projected position in which said upper end portion of said retainer projects from the top of said die for engaging a peripheral edge of a head of the other fastener element to thereby prevent the latter from being displaced on the top of said die.

2. An apparatus according to claim 1, said lower unit further including a spring normally urging said retainer to said projected position, said upper end portion of said retainer having a slanted top surface, said second pusher having a pushing arm pivotally mounted on a forward end of said second pusher, said pushing arm, as the latter is disposed adjacent to said die, being engageable with said slanted top surface so as to depress said retainer to said retracted position against the bias of said spring.

3. An apparatus according to claim 2, said second pusher mechanism further including a pair of clamping members disposed at an intermediate position of said second guide cchannel temporaily clamping the other fastener element and at least one spring normally urging said clamping members one toward the other, said pushing arm being movable, in response to the reciprocating movement of said second second pusher, between an advanced position in which said pushing arm is disposed over said retainer and a retracted position in which said pushing arm is disposed behind said clamping members.

4. An apparatus according to claim 3, each of said clamping members having a guide projection extending into said second guide channel for being disposed below the other fastener element clamped between said clamping members, said guide projection having on its lower side a first slanted camming surface engageable with an upper edge of said pushing.arm when the latter is moved backwardly under said clamping members, such two guide projections having on their inner sides a pair of rearwardly diverging second slanted surfaces, said lower edge of said pushing arm, when the latter is moved forwardly through said clamping members, being engageable with said second slanted surfaces so as to separate said clamp members away from one another against the bias of said spring.

5. An apparatus according to claim 1, said upper unit further including a pair of clamp members pivotally mounted on said punch for clamping the one fastener element supplied from said first pusher mechanism, said punch having on its lower end a pair of downwardly directed guide projections having a pair of arcuate inner surfaces for receiving the one fastener element therebetween as said punch is moved downwardly, said guide projections having along their respective lower ends a pair of slanted guide surfaces contiguous to said inner surfaces and diverging downwardly, each of said slanted guide surfaces, when the one fastener element is vertically unaligned with said punch, being engageable with the peripheral edge of the head portion of the one fastener element so as to correct such displacement of the one fastener element.

6. An apparatus according to claim 5, said guide projections and said clamp members being disposed alternately along a periphery of said punch.

7. An apparatus according to claim 6, each said slanted surface being concave.

* * * * *